United States Patent [19]

Merisio

[11] 4,086,942

[45] May 2, 1978

[54] WEFT FEED TENSIONING DEVICE IN LOOMS HAVING A STATIONARY WEFT SUPPLY

[75] Inventor: Alberto Merisio, Colzate, Italy

[73] Assignee: Somet Societa Meccanica Tessile, S.p.A., Gazzaniga, Italy

[21] Appl. No.: 707,019

[22] Filed: Jul. 20, 1976

[30] Foreign Application Priority Data

Jul. 25, 1975 Italy ..... 25756 A/75

[51] Int. Cl.[2] ..... D03D 47/34

[52] U.S. Cl. ..... 139/450; 242/149

[58] Field of Search ..... 139/429, 450, 452; 112/241, 242; 242/147, 149, 150; 66/146

[56] References Cited

U.S. PATENT DOCUMENTS

| | | | |
|---|---|---|---|
| 2,089,620 | 8/1937 | Rossmann | 139/450 |
| 2,407,773 | 9/1946 | Fletcher | 139/450 |
| 2,912,185 | 11/1959 | Vossen | 242/150 |
| 3,347,283 | 10/1967 | Bartosek et al. | 139/450 |
| 3,378,040 | 4/1968 | Moessinger | 139/450 |
| 3,595,498 | 7/1971 | Mackie | 242/149 |

*Primary Examiner*—Henry S. Jaudon

*Attorney, Agent, or Firm*—Stevens, Davis, Miller & Mosher

[57] ABSTRACT

A device for weft tensioning adjustment in weaving looms of the type having continuous weft feed, to be applied at the side of the loom. The device comprises - mounted on a single support - a pair of elastic resilient laminae, biased into mutual contact with an adjustable pressure knob and arranged in the path of the weft thread being supplied, for engaging said thread between them and providing for the braking thereof, and an oscillating lever ending with a threadguide, through which eye is passed the weft thread, after engagement between said laminae and before reaching carrying members, said oscillating lever being adjustably urged by spring means to move away from said laminae and from said members, in order to take up slack in said weft thread when it exists.

5 Claims, 1 Drawing Figure

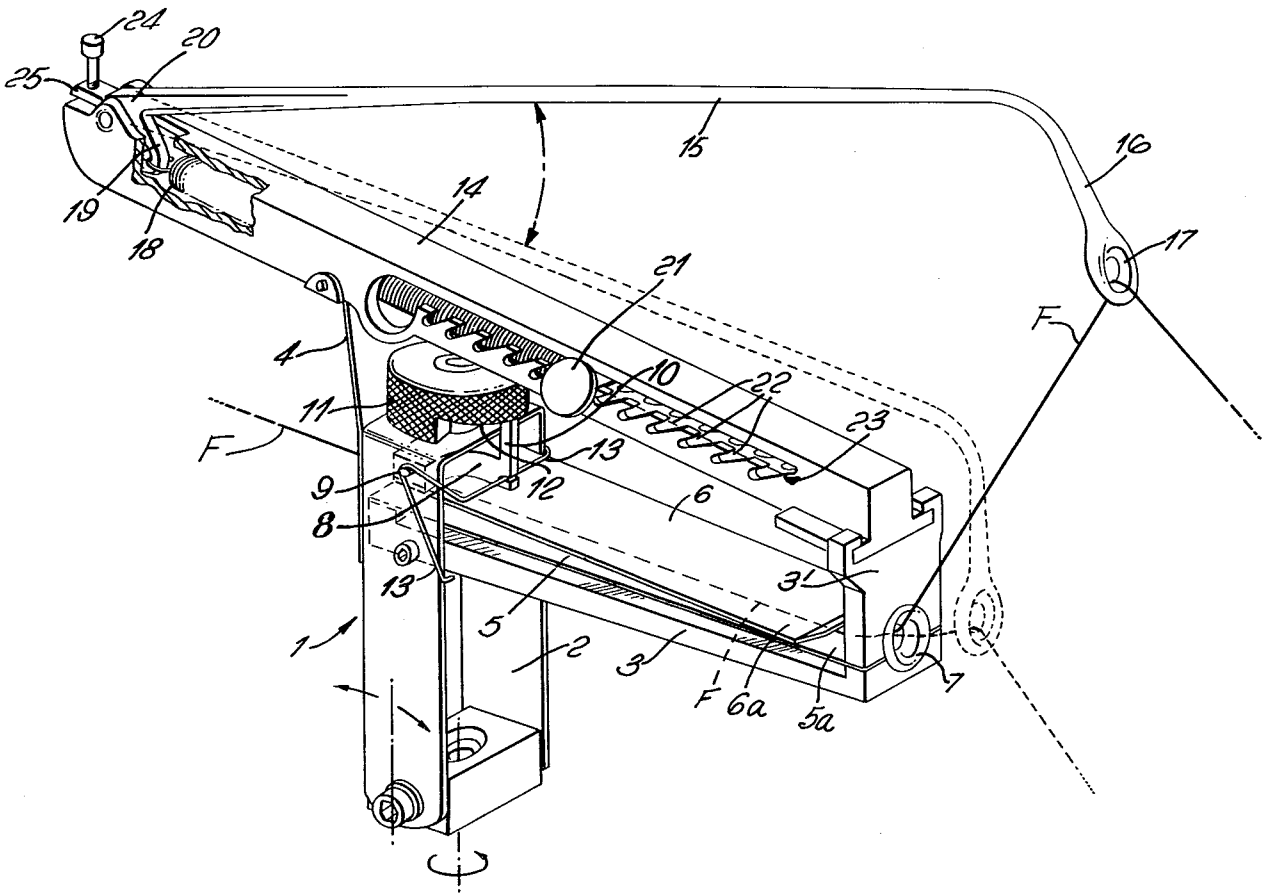
16
17
F
15
21
14
20
24
25
18
19
23
22
10
13
12
6
4
11
9
8
F
7
3
5a
6a
F
3
2
5
13
1

WEFT FEED TENSIONING DEVICE IN LOOMS HAVING A STATIONARY WEFT SUPPLY

BACKGROUND OF THE INVENTION

The present invention relates to a device designed to guarantee a regular tensioning of the weft threads in weaving looms of the type having continuous weft feed using, instead of the common shuttles, weft carrying members such as grippers and the like.

In such looms, the weft threads are supplied to the carrying members from only one side of the loom, and means are provided — to obtain a correct running of the loom itself — adapted to adjust said tensioning, so that it may take place with a tension close to carefully preselected values. In spite of this, however — due to the variable motion imparted on the weft carrying members and/or to irregularities in the running of the loom — there may be variations in the tension of the weft itself, which would prejudice the correct performance of the work and even the regular working of the loom. To prevent these drawbacks, it has been thought to equip the looms of the aforementioned type, with a device for adjusting the supply of weft yarns comprising, on one hand, means for smoothly braking the weft thread just before it is gripped by the carrying members and, on the other hand, means for recovering the excess amounts of weft thread, which are formed between said brake means and the carrying member, due to the motion of the latter.

SUMMARY OF THE INVENTION

The device is substantially characterized in that it comprises — mounted on a single support — a pair of elastic resilient laminae, driven into mutual contact with an adjustable pessure and arranged in the path of the weft thread, for engaging said thread between them and providing for the braking thereof, and an oscillating lever ending with a threadguide, through which eye is passed the weft thread, after engagement between said laminae and before carrying members, said oscillating lever being adjustably urged by spring means to move away from said laminae and from said members, in order to take up slack in said weft thread then it exists.

Preferably, said pair of laminae comprises a first metal lamina extending in the weft thread feeding direction and fixed with both ends to the support, and a second metal lamina, mounted cantilevered on the same support, substantially parallel to the first lamina, means acting on the second lamina to drive its free end into contact with the first lamina with an adjustable pressure. Moreover, the second lamina is appropriately carried by a small oscillating support comprising a cam-follower, while the means for driving the end of the second lamina in contact with the first, comprise a cam cooperating with the cam-follower and adapted to be operated by turning a knurled knob.

The oscillating lever is preferably carried by the end of an elongated box-like body, fixed to the support and housing the spring means urging the lever itself, the body comprising a plurality of attachments for the spring means, allowing to vary the tension and hence the action of the means.

BRIEF DESCRIPTION OF THE DRAWING

A preferred embodiment of the invention is illustrated in the accompanying drawing, which shows an axonometric view — with some interrupted parts — of the device according to the invention, and to which reference is made in the detailed description given hereinafter.

DESCRIPTION OF THE PREFERRED EMBODIMENT

The device according to the invention comprises a support 1 in three parts, of which part 2 is fixed to the loom, in correspondence of its side from which the weft yarn is fed, while parts 3 and 4 extend, respectively, on one side into a square-bent portion and, on the other side, slanting upward from said part 2, which is mounted substantially vertically.

The support 1 carries a pair of metal laminae 5 and 6, extending substantially parallel to its part 3. The metal lamina 5 is fixed with its ends to part 3, on its outer side 3', just below a threadguide 7 mounted on part 3 itself. The lamina 6 is instead mounted cantilevered on a small oscillating support 8, pivoted at 9 to the part 2 of the support 1 and provided at the top with a pin 10 acting as a cam-follower. A large knurled knob 11 is rotatably mounted at the top of the support 1, rotating about an axis parallel to the part 2 of the support itself, i.e., substantially vertically the lower part of the knob is formed as a face cam 12, through part of its extension, and the cam is engaged by the free upper end of the pin 10 of the support 8 of the lamina 6. Reference 13 indicates a wire spring acting between part 2 of the support 1 and the support 8, to cause the rotation of the latter in the sense of moving the lamina 6 at 6a away from the lamina 5 at 5a.

On parts 3 and 4 of the support 1 is mounted an elongated box-like body 14, onto the end of which close to part 4 is pivoted a light and slender oscillating lever 15, extending beyond the opposite end of the body 14, where it ends with a square-bent portion 16, provided with a threadguide 17. The lever 15 is urged to move upwardly away from the box-like body 14 — by a spring 18 housed inside the body and connected with an end to the small arm 19, projecting from the pivoting part 20 of the lever 15 itself. The other end of the spring is connected to a clamp 21, which may in turn be inserted in any one of a plurality of hooks 22, provided in pairs on the lateral walls of a slotted portion 23 of the box-like body 14. Reference 24 indicates a setscrew, placed on a tab 25 of the pivoting part 20 of the lever 15, and adapted to adjust the top lift position of the lever 15 itself. In use, the weft thread F is inserted in the threadguides 7 and 17 either from the feeding reel with associated devices, or from the two laminae 5 and 6, which are in more or less close contact with each other, for imparting a more or less strong braking action on the thread itself. From the second threadguide 17, the thread F moves towards the weft-carrying member (not shown).

As the weft-carrying member moves along, it carries with it the weft thread F, which is being braked between the laminae 5 and 6 and subjected to a lifting action by the lever 15.

In practice, the braking action — usually not very strong — imparted by the laminae 5 and 6, ensures a regular flow of the weft thread being pulled by the carrying member, while, when said member slows down and the weft thread, previously pulled with more energy, is inclined to loosen and pile up between the threadguide 7 and the actual carrying member. The lever 15 (which, from the normal position shown in dashed lines, places itself in the position shown in full lines, in the accompanying drawing) lifts the thread, so that there is an efficient recovery of the actual excess thread, up to the subsequent pulling action by the carrying member.

In this way, the tension of the weft thread, in respect of the carrying members provided therefor, always remains within values which are very close to the ideal values, with obvious advantages for the looms working conditions and for the proper execution of the fabric being weaved. It should be noted that the described device allows a very accurate adjustment, both of the coupling force between the laminae 5 and 6 and of the lifting force applied on the lever 15. In the first case, it is sufficient to slowly turn the knob 11, the cam 12 of which causes the oscillation — through the cam-follower 10 — of the support 8 of the lamina 6, against the action of the spring 13. Due to the friction involved and to the limited action of the spring, any position of the knob 11, and hence of the lamina 6, is perfectly stable. In the second case, it is sufficient to move the clamp 21 from one hook 22 to any of the adjacent ones, in the box-like body 14. Thanks to the large number of hooks 22, the adjustment will satisfy any requirements.

It is understood that the above described embodiment of the invention has been provided by mere way of example, and that further embodiments of the device for adjusting the tension of weft threads being fed to looms, may be provided without thereby departing from the scope of the present invention. It is evident that modifications and variants of the aforedescribed embodiment may equally be provided.

I claim:

1. A device for adjustably tensioning the weft in loom weaving from a stationary weft supply, to be applied at the side of the loom from which the weft is fed to the members carrying the weft through the shed, comprising, a single support, a pair of elastic resilient metal laminae, arranged substantially parallel to each other and on opposed sides of the path of the weft, one of said laminae being fixed with both ends to said support, said other metal lamina mounted cantilevered on said support, means acting on said other lamina to urge its free end into contact with the first lamina with an adjustable pressure for engaging said weft between the laminae and providing for the braking thereof, an oscillating lever having at one end a threadguide, through which passes the weft after engagement between said laminae and before reaching said carrying members and at the other end a small arm, means pivotally mounting said lever at said other end and adjustable spring means acting on said lever through said small arm to cause it to oscillate and move away from said laminae and from said members, in order to take up slack and retain tension in the weft.

2. The device as in claim 1, including an oscillating support carrying said lamina, said oscillating support having a cam-follower, and said means for urging the end of said other lamina in contact with the lamina fixed at both ends comprising a cam cooperating with said cam-follower and adapted to be operated by turning a knurled knob.

3. The device as in claim 2, including spring means adapted to oppose the movements of said other lamina in respect of the lamina fixed at both ends, said spring means being controlled by said cam.

4. The device as in claim 1, including an elongated box-like body fixed to said single support and housing said adjustable spring means, said body comprising a plurality of attachments for said adjustable spring means, allowing variation in the tension of said adjustable spring means, said oscillating lever being carried at its end at the end of said body.

5. The device as in claim 4, wherein said adjustable spring means consist of a cylindrical helical spring, fixed at one end to said small arm of said oxcillating lever, and at its other end to a clamp, adapted to be inserted in any one of a plurality of hooks aligned along said hollow body.

* * * * *